US005293975A

United States Patent [19]

Howorka

[11] Patent Number: 5,293,975

[45] Date of Patent: Mar. 15, 1994

[54] BRIEFCASE PROTECTOR WITH A HANDLE COVER PORTION

[76] Inventor: David J. Howorka, 1730 North Clark St., Suite 307, Chicago, Ill. 60614

[21] Appl. No.: 981,231

[22] Filed: Nov. 25, 1992

Related U.S. Application Data

[63] Continuation-in-part of Ser. No. 930,208, Aug. 13, 1992.

[51] Int. Cl.[5] ..... A45C 13/00

[52] U.S. Cl. ..... 190/26; 150/105; 150/154

[58] Field of Search ..... 190/26, 100; 150/104, 150/105, 154, 155

[56] References Cited

U.S. PATENT DOCUMENTS

| | | | |
|---|---|---|---|
| 1,008,604 | 11/1911 | Lake | 150/155 X |
| 1,526,839 | 2/1925 | Dempsey | 190/26 |
| 2,051,092 | 8/1936 | Landes | 150/105 |
| 2,432,365 | 12/1947 | Allen | 190/26 |
| 2,647,595 | 8/1953 | Meyers | 190/26 |
| 2,693,259 | 11/1952 | Amick | 190/26 |
| 2,711,234 | 6/1955 | Rubens | 190/26 |
| 2,724,467 | 11/1955 | Jaffe | 190/26 |
| 2,732,046 | 1/1956 | Smallberg | 190/26 |
| 2,985,212 | 5/1961 | Dozier | 150/159 |
| 3,349,992 | 10/1967 | Skinner | 150/165 |
| 3,901,360 | 8/1975 | Cook | 190/26 |
| 4,026,339 | 5/1977 | Burke | 150/106 X |
| 4,953,674 | 9/1990 | Landes | 190/26 |
| 5,010,987 | 4/1991 | Evans | 190/26 |
| 5,083,644 | 1/1992 | Collins, III | 190/26 |
| 5,172,795 | 12/1992 | Riceman | 190/26 |

FOREIGN PATENT DOCUMENTS

| | | | |
|---|---|---|---|
| 1038915 | 10/1953 | France | 150/154 |
| 2537516 | 6/1984 | France | 150/154 |
| 2147497 | 5/1985 | United Kingdom | 190/100 |
| 2167656 | 6/1986 | United Kingdom | 190/26 |

*Primary Examiner*—Sue A. Weaver

*Attorney, Agent, or Firm*—Allegretti & Witcoff, Ltd.

[57] ABSTRACT

A universal briefcase protector for use with briefcases of various sizes and shapes. The briefcase protector of the present invention protects both the body of the briefcase as well as the handles. Additionally, the briefcase protector allow for normal carrying of the briefcase even when the protector is employed.

5 Claims, 2 Drawing Sheets

FIG. 5
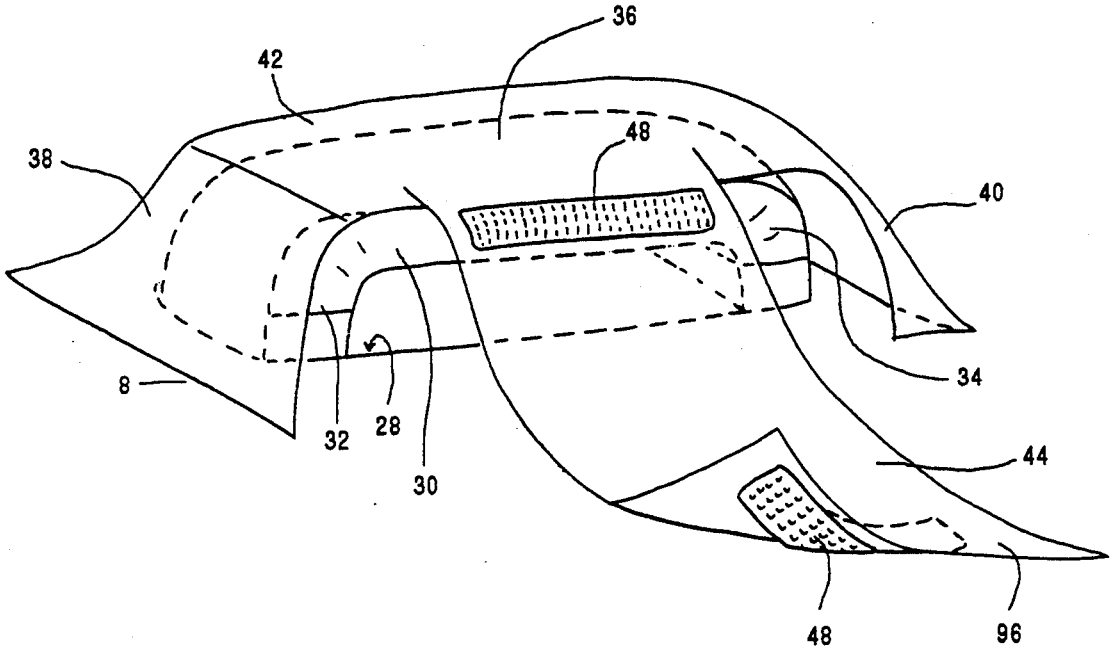
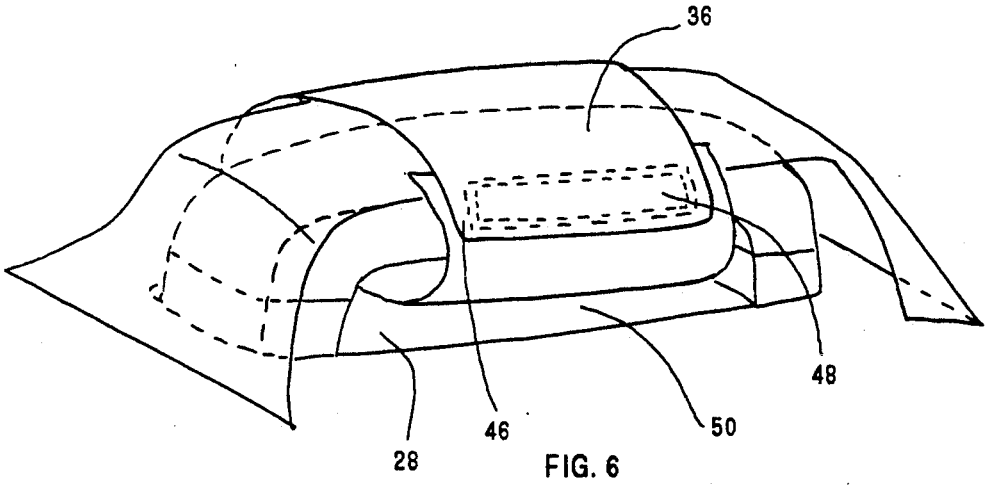
FIG. 6

BRIEFCASE PROTECTOR WITH A HANDLE COVER PORTION

RELATED APPLICATIONS

This application is a continuation-in-part application of U.S. patent application Ser. No. 07/930,208 filed on Aug. 13, 1992.

FIELD OF THE INVENTION

This invention relates generally to luggage covers and protectors, including covers for suitcases, briefcases, computer cases and the like. More specifically, the invention relates to a protector that is adapted to fit in a unitary manner over an entire piece of luggage, including the handle, while allowing the handle to be gripped in a normal manner. The protector protects both the containment portion and the handle assembly of the luggage from damage due to physical impact or inclement weather, while at the same time being easily removeable.

BACKGROUND OF THE INVENTION

The need for protector to protect the outer surfaces of briefcases and luggage has long been recognized. By their very nature, briefcases and other such cases are subject to damage from physical abrasions or scratches, or from rain or snow. Such damage can not only produce unsightly marks, but can in fact ruin the case. While briefcases are very expensive, briefcase protectors can easily be replaced at a relatively small expense if damaged. Therefore, the prior art shows several attempts to create luggage protectors for such purposes.

U.S. Pat. No. 2,647,595 (Meyers) issued Aug. 4, 1953 discloses a supplementary protector to protect luggage. This patent relates to a luggage protector which is slipped over the top of luggage and secured beneath the luggage by elastic strips. The patent does not address means for covering the handle of the luggage.

U.S. Pat. No. 2,693,295 (Amick) issued Nov. 2, 1954 relates to a luggage cover. Amick teaches a suitcase cover which is folded around a suitcase through the use of flaps and snap fasteners. The Amick luggage cover does not protect the suitcase handle.

U.S. Pat. No. 2,711,234 (Rubens) issued Jun. 1, 1955 relates to an adjustable luggage cover. This patent discloses a cover that adjusts through the use of elastic strands to fit over various sizes of luggage. The cover described by the Rubens patent does not protect the handle of the luggage.

U.S. Pat. No. 2,732,046 (Smallberg) issued Jan. 24, 1956 discloses luggage covers for rigid walled luggage. This patent teaches the use of elastic portions which provide a snug fit over such luggage and allow for slight variations in the size of the luggage.

U.S. Pat. No. 2,724,467 (Jaffe) issued Nov. 22, 1955 relates to a luggage cover. The luggage cover disclosed in the Jaffe patent utilizes fastening means surrounding the outside of the cover to close the protected luggage.

U.S. Pat. No. 3,901,360 (Cook) issued Aug. 26, 1975 discloses a luggage protector. This patent teaches a unitary protector having a slit opening for the handle and having a single closure means extending all the way around the body of the luggage protector.

In each of these references, the protector is designed in such a way as to leave the handle of the briefcase exposed. Furthermore, the opening through which the handle protrudes is typically uncovered, allowing water or other materials to leak into the protector. A need therefore exists for a protector that provides protection not only for the main storage portion of the briefcase, but also for the handle, while allowing the handle to be grasped in a normal manner. Such a protector should be designed so as to adapt quickly and easily to fit over a variety of sizes and shapes of briefcases.

It is therefore an object of the present invention to provide a briefcase protector which protects not only the baggage portion of the briefcase, but also the handle portion.

A further object of the present invention is to provide a briefcase protector that protects the handle of a briefcase in such a way as to allow the briefcase to be grasped and carried in a normal manner.

Another object of the present invention is to provide a briefcase protector that can be quickly and easily fastened or removed.

It is another object of the present invention to provide a briefcase protector which may be used in conjunction with briefcases of various sizes and shapes.

It is still another object of the present invention to provide a briefcase protector which is small and easily transportable so that when it is not in use, it can be carried inside the briefcase. These and other objects of the present invention will be made clear through the following detailed description of the preferred embodiment.

SUMMARY OF THE INVENTION

In a basic aspect, the present invention is a unitary protector for protecting a briefcase or other luggage from damage due to physical abrasion or inclement weather. The protector is adapted to be lowered over a briefcase so as to enclose the top and the sides of the briefcase, while being capable of being tightened about the bottom of the briefcase. Additionally, the protector extends over the handle of the briefcase, guarding it from damage, while preventing leaks into the top of the protector through the handle opening. The protector includes a body of flexible material adapted to enclose the briefcase, and a handle cover adapted to enclose the briefcase's handle. The flexible body has a primary opening for allowing introduction of the briefcase into the body, and a handle opening to allow the handle of the briefcase to protrude from the body. Once the protector has been slipped completely over the briefcase, the primary opening at the bottom of the protector can be partially or completely closed, for instance by gathering the periphery of the opening together through the use of a drawstring or other suitable closure device.

BRIEF DESCRIPTION OF THE DRAWINGS

FIG. 5 is a closeup perspective view of a handle cover, with a protective flap in the open position.

FIG. 6 is a closeup perspective view of a handle cover, with a protective flap in the closed position.

DETAILED DESCRIPTION OF THE PRESENT INVENTION

Figure 1:
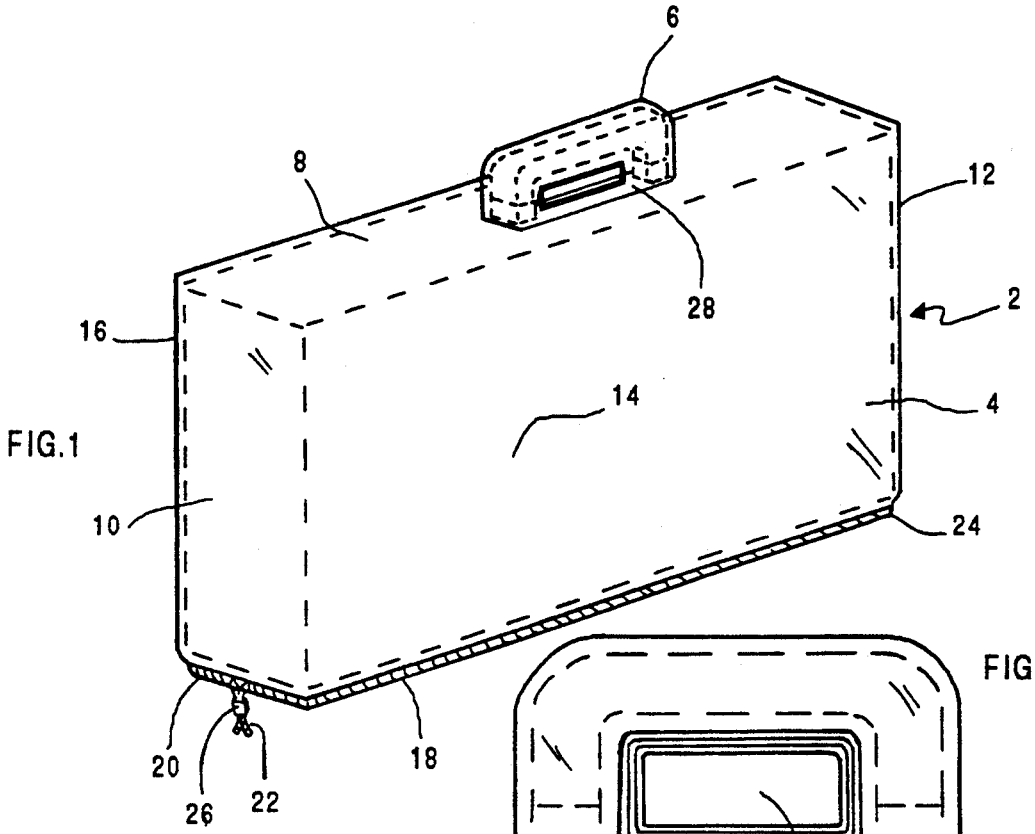
FIG. 1 is a perspective view of a briefcase protector made in accordance with the present invention surrounding a briefcase.

As shown in FIG. 1, the present invention is a briefcase protector 2 useful for protecting a briefcase from damage due to the weather or normal use. The protector 2 is comprised of a unitary body 4 that slips over the top of the briefcase, and a handle cover 6 that protects the handle of the briefcase. The body of the protector may comprise a top panel 8 at its top end, first and second end panels 10 and 12, and first and second side panels 14 and 16. The top panel may have opposing side and end edges, with the side and end panels connected to or extending downward from those edges. The adjacent edges of the side and end panels may be connected to form a unitary structure. The body 4 should be of an adequate size to fit over various sizes and shapes of briefcases. The bottom end of the body 4 is positioned opposite the top end.

Figure 4:
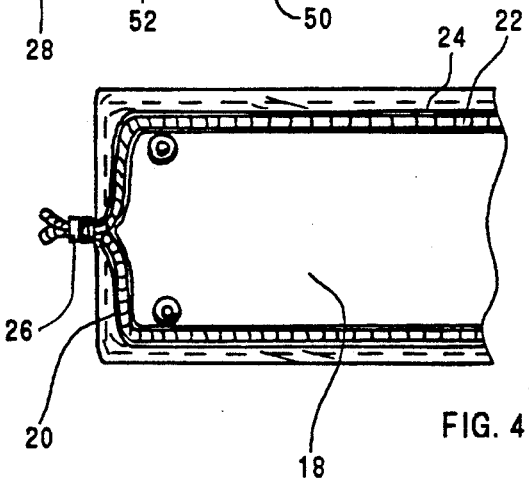
FIG. 4 is a bottom view of a briefcase protector made in accordance with the present invention.

The body defines a primary opening 18, also shown in FIG. 4, for allowing the briefcase to be introduced into the body 4 of the protector 2. The opening 18 is preferably defined at the bottom end of the end of the protector, i.e., at the bottom of the side and end panels, opposite the top panel. That configuration allows the protector to be slipped downward into place over the top of a briefcase as the briefcase rests on the ground. The opening 18 can, however, be positioned elsewhere on the protector. The primary opening 18 can be equipped with a closure device 20. The closure device closes the opening 18, i.e., reduces the size of the opening 18 once the protector is fully in place, sufficiently to hold the protector in place and prevent it from slipping off of the briefcase. In a preferred embodiment, the closure device comprises a drawstring 22, slidably disposed within a channel 24 that surrounds the periphery of the opening 18. The opposing ends of the drawstring exit the channel through a slit, and are held together by frictional quick-release clamp 26. The clamp 26 allows the drawsting to be adjustably tightended or loosened. To remove the briefcase protector 2, the clamp 26 is released, allowing the opening 18 to be expanded. The protector is then slipped off of the briefcase.

As shown in FIGS. 1, 2, 5 and 6, the body of the briefcase, preferably at the top panel 8, defines a handle opening 28 to allow the handle of the briefcase to protrude from the body of the protector. The handle opening 28 is generally rectangular, preferably having a length and width that conforms generally to the length and width of a typical briefcase handle. The body of the protector, again preferably at the top panel 8, comprises a handle cover 6 for protecting the handle of the briefcase when the briefcase is being carried. The handle cover 6 can either be an extension of the body 4, as shown in FIG. 1, or can be a separate piece that is stitched or otherwise fastened onto the body, as shown in FIG. 5 or 6. The specific shape of the handle cover can be varied to conform to the particular handle design for a given briefcase of luggage style. A handle cover that is suitable for use with a typical briefcase handle 30, is shown in FIGS. 5 and 6. A briefcase handle typically comprises first and second legs 32 and 34, and a cross member 36 (shown as a dashed line in FIGS. 5 and 6) that bridges between and connects the two legs. To conform to the shape of such a handle 30, the handle cover 6 therefore comprises corresponding first and second leg portions, 38 and 40, each of which extends from the top panel 8 at a position adjacent to one of the narrow ends of the handle opening 28. The leg portions 38 and 40 of the handle cover 6 are connected by a horizontal portion 42, which protects the cross member of the briefcase handle. A protective flap 44, generally rectangular in shape, is attached on one side of the horizontal portion 42, with the opposite end 46 of the protective flap 44 being freely moveable. In use, as shown in FIG. 6, the free end 46 of the protective flap 44 is passed underneath the cross member of the briefcase handle, so that the protective flap is wrapped completely around the cross member. The free end 46 of the protective flap is then fastened to the handle cover 6 by a fastener 48. The fastener is preferably a strip of hook-and-loop tape, such as that sold by Velcro USA, Inc. under the registered trademark VELCRO. In that embodiment, either the hook or loop component of the tape is attached to the free end 46 of the protective flap 44; the complementary component of the tape is attached to the handle cover 6 in a position that will allow the hook component and the loop component to mate when the protective flap is closed around the briefcase handle. The protective flap can also be held into place by any other suitable fasteners, including snaps, zippers or the like. When the protective flap 44 is in place, the handle cover 6 defines a grip opening 50 through which the briefcase handle can be grasped.

Figure 2:
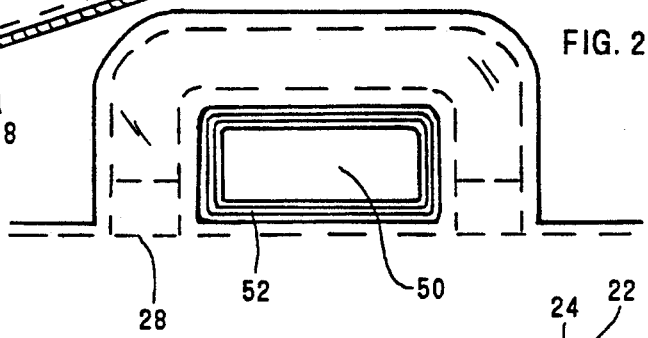
FIG. 2 is a closeup view of a handle protector portion of a briefcase protector made in accordance with the present invention.
Figure 3:
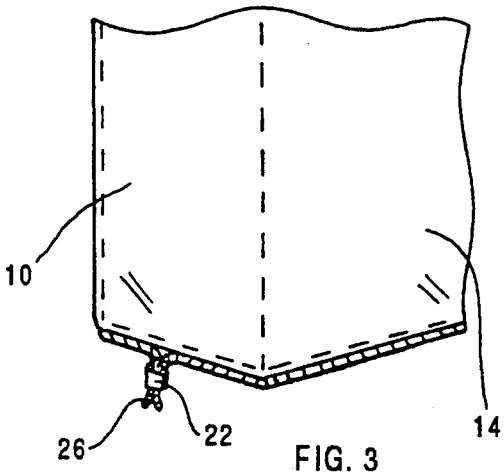
FIG. 3 is a closeup view of the bottom end of a briefcase protector made in accordance with the present invention.

In an alternative embodiment, shown in FIGS. 1 and 2, the material making up the legs and bridging portion of the handle cover can be of sufficient length to allow it to surround entirely the corresponding portion of the briefcase handle. For instance, each leg portion of the handle cover can be of sufficient size to completely surround and enclose the corresponding leg of the briefcase handle. Similarly, the bridging portion of the handle cover can completely surround and enclose the cross member of the briefcase handle. Once the various portions of the handle cover have been gathered together to enclose the briefcase handle, they can be connected together to seal off the briefcase entirely. To do so, the entire handle cover, as well as the handle opening 28 is sealed off through the use of a sealing means 52. The sealing means 52 can be hook-and-loop tape, or a zipper, or in a preferred embodiment, a system of interlocking channels that zip together to close the handle cover around the briefcase handle. Such interlocking channels are widely used in other flexible plastic products, such as in plastic sandwich bags.

In a preferred embodiment, the material of the briefcase protector 2 should be flexible, durable and water resistant. Suitable material include flexible plastics, nylon, fabrics, leather or the like. It is also desirable to use materials that are capable of being silk screened. In this manner, logos, advertisements and designs may be place directly on the briefcase protector. The briefcase protectors can then be used as promotional items, or can be designed to the user's taste.

The invention is generally described and claimed herein in relation to a briefcase; however, it should be understood that such description includes protectors for use with other similar types of carrying cases, such as suitcases or computer cases. Furthermore, while in the foregoing there have been described preferred embodiments of the invention, it should be understood to those skilled in the art that various modifications and changes can be made without departing from the true spirit and scope of the invention as recited in the following claims.

I claim as my invention:

1. A removable protector for a briefcase having an arched handle around which the fingers of a hand can be gripped, said protector comprising a body of flexible material, the body comprising a top panel having opposing side edges and a handle opening therein, and first and second side panels, each side panel having a top edge, a bottom edge and opposing side edges, the top edges of the side panels being joined to opposite side edges of the top panel, with the bottom edges of the side panels being unjoined so as to permit the body to be draped downwardly over the briefcase with the handle of the briefcase extending through the handle opening; and a handle cover comprising first and second legs that are connected to and extend from the body on opposite sides of the handle opening, and a bridging portion that connects the extended ends of the first and second legs, the legs and bridging portion being dimensioned so as to conform to the outer shape of the briefcase handle while defining a grip opening through which the briefcase handle can be grasped as it protrudes through the handle opening.

2. The protector of claim 1, wherein the handle cover further comprises a protective flap that extends from the bridging portion of the handle cover and terminates at a free end, and means for releasably fastening the free end of the protective flap to the handle cover after the free end has been passed through a briefcase handle protruding through the handle opening.

3. The protector of claim 2, wherein the means for fastening the free end of the protective flap to the handle cover comprises hook-loop tape.

4. A protector for a briefcase having an arched handle around which the fingers of a hand can be gripped, said protector comprising a body of flexible material dimensioned to enclose the briefcase, the body comprising a top panel having opposing side edges and opposing end edges and a handle opening therein, first and second side panels and first and second end panels, each of said side and end panels having a top edge, a bottom edge and opposing side edges, wherein the tope edges of the side panels are joined to the side edges of the top panel, and the top edges of the end panels being joined to the end edges of the top panel, the adjacent side edges of the side and end panels being joined together, and the bottom edges of the side and end panels being unjoined so as to permit the body to be slipped downwardly over the briefcase with the handle of the briefcase extending through the handle opening; and a handle cover comprising first and second legs that extend from the body on opposite sides of the handle opening and a bridging portion that connects the extended ends of the first and second legs, the legs and bridging portion of the handle cover being dimensioned so as to conform to the outer shape of the briefcase handle, while defining a grip opening through which the briefcase handle can be grasped as it protrudes through the handle opening in the body, the handle cover further comprising a protective flap that extends from the bridging portion of the handle cover and terminates at a free end, and means for releasably fastening the free end of the protective flap to the handle cover after the free end has been passed through a briefcase handle protruding through the handle opening.

5. The protector of claim 4, wherein the means for fastening the free end of the protective flap to the handle cover comprises hook-loop tape.

* * * * *